US005094730A

United States Patent [19]

Niehaus et al.

[11] Patent Number: 5,094,730

[45] Date of Patent: Mar. 10, 1992

[54] METHOD FOR FORMING A METALLIC COATING ON STEEL PIPES

[75] Inventors: Norbert Niehaus, Düsseldorf; Werner Friehe, Mülheim/Ruhr; Wilhelm Schwenk, Duisburg, all of Fed. Rep. of Germany

[73] Assignee: Mannesmann Aktiengesellschaft, Düsseldorf, Fed. Rep. of Germany

[21] Appl. No.: 455,959

[22] Filed: Dec. 22, 1989

[30] Foreign Application Priority Data

Dec. 23, 1988 [DE] Fed. Rep. of Germany ..... 3844160

[51] Int. Cl.[5] ..... C25D 5/10; C25D 5/50

[52] U.S. Cl. ..... 205/151; 148/127; 205/170; 205/176; 205/217; 205/226

[58] Field of Search ..... 204/25, 26, 37.1, 37.3, 204/40; 148/127

[56] References Cited

U.S. PATENT DOCUMENTS

| | | | |
|---|---|---|---|
| 3,285,838 | 11/1966 | Morgan et al. | 204/37.3 |
| 4,432,487 | 2/1984 | Shibata | 228/194 |
| 4,513,995 | 4/1985 | Niehaus et al. | 285/55 |
| 4,726,208 | 2/1988 | Saunders | 72/47 |

*Primary Examiner*—John Niebling
*Assistant Examiner*—William T. Leader
*Attorney, Agent, or Firm*—Cohen, Pontani & Lieberman

[57] ABSTRACT

A method of applying a metallic coating to metallic sealing and/or threaded regions of steel pipes which are under high pressure per unit of surface by a pretreatment of the surface to be coated which consists of a cleaning and degreasing and an electrolytic deposition of a layer of tin by a first heat treatment at a temperature between about 150° and about 200° C. and a second brief heat treatment above the melting point of tin with subsequent cooling is provided. A metallic coating which is formed using said method is also provided.

1 Claim, No Drawings

METHOD FOR FORMING A METALLIC COATING ON STEEL PIPES

FIELD OF THE INVENTION

The present invention relates to a method of applying a metallic coating to metallic sealing and/or threaded regions of steel pipes which are under high pressure per unit of surface by a pretreatment of the surface to be coated which consists of a cleaning and degreasing and an electrolytic deposition of a layer of tin by a first heat treatment at a temperature between about 150° and about 200° C. and a second brief heat treatment above the melting point of tin with subsequent cooling. The invention also relates to a metallic coating which is formed using said method.

BACKGROUND OF THE INVENTION

Steel pipes for the recovery of petroleum and natural gas are screwed together to form strings of pipe, the connections being subject to high mechanical stresses. Furthermore, they must also still be capable of being screwed and frequently screwed under stress. Additionally, depending on the type of thread—the connections must be gas-tight for certain applications, such as tubing (e.g., risers) for natural gas. Steel-pipe materials tend in this connection to undergo cold welding, so-called galling on the surfaces which slide on each other. It has therefore already frequently been proposed to coat the surfaces in the thread and on the metallic sealing seat which slide on each other with a nonferrous metal such as copper or tin (Federal Republic of Germany OX 31 47 967). The selection of the most suitable nonferrous metals and of their ability to adhere to the pipe material is important in this connection, as well as their ductility. For this it has also been proposed to apply a layer of lead, zinc, cadmium or bismuth to the sealing and/or threaded regions, this layer consisting of about 1 to 10% tin and being about 3 to 20μm thick (EP OS 246 387). This proposal has the disadvantage of insufficient adherence of the layer applied, so that it cannot take up thrust forces which occur during the screwing process.

SUMMARY OF THE INVENTION

An object of the present invention is to provide a method of applying a metallic coating to the sealing and/or threaded regions of steel pipes for the recovery of oil and natural gas, by a pretreatment of the surface to be coated which consists of a cleaning and degreasing and an electrolytic deposition of a layer of tin by a first heat treatment at a temperature between about 150° and about 200° C. and a second brief heat treatment at a temperature up to about 50° K. above the melting point of tin with subsequent cooling. The invention also relates to a metallic coating which is formed using said method. Said metallic coating dependably prevents galling in the case of a grease-free screwing even upon multiple screwing, and optimizes the sealing effect of pipe sealing and/or threaded regions.

DESCRIPTION OF THE PREFERRED EMBODIMENT

The method of the invention is characterized by the fact that an electrolytically deposited base layer, which consists either of pure tin or of a tin-containing pseudo-alloy, adheres firmly to the base material after a brief heat treatment in the range between about 1 and about 10 seconds at a temperature up to about 50° K. above the melting point of the tin (m.p. 232° C. in pure form). The adherence is obtained in the manner that, due to the melting-on of the tin, the latter diffuses into the base material and forms an intermetallic reaction layer. This reaction layer bonds the base material to the electrolytically deposited base layer. Without such a connection, the electrolytically-deposited layer would be pushed away from the base material as a result of the thrust forces which occur upon the screwing.

Another advantage of the method of the present invention results from the fact that, in contradistinction to the already known tinning of the sealing and/or threaded regions of the steel pipes, an element selected from the group of ductile nonferrous metals is electrolytically deposited on such a firmly adhering base layer. Lead is particularly advantageous for this, it having further favorable properties as compared with tin. As an alternative for the deposition of pure lead, it is further contemplated in accordance with the present invention to electrolytically deposit, instead of this, a lead-tin pseudo alloy and to bind said layer to the base material by the heat treatment already described.

The metallic coating of the invention does not exhibit any welding together in the threaded region under high surface pressure, while at the same time achieving a sealing action. The screwing is effected without lubricant, as a result of which screwing is simplified and cost-favorable. Due to the excellent bonding of the electrolytically-deposited layer on the base material, such a metallic coating is particularly suited, for instance, for drill pipes and drill collars which have a relatively coarse thread and are frequently screwed and unscrewed. This coating also makes possible a hermetic sealing of the metal-to-metal type if only one of the two sealing surfaces is provided with such a coating. Therefore such a metallic coating is recommended also for casings. Since both of the above-mentioned properties are present simultaneously, the metallic coating is also excellently suited, in particular, for tubings, such as risers, for natural gas.

The use of the method will be explained in further detail, by way of example, with reference to the coating of socket threads.

EXAMPLE

The starting products are lengths of pipe which are heat-treated or cold-worked to the desired mechanical strength and machined to the final shape of the socket and, in particular, provided with a thread. The socket is degreased alkalinly in the heated state in the following sequence, and without enumerating in detail the intermediate required flushing and drying processes, the surface is activated with a dilute mixture of hydrochloric acid and nitric acid and provided, without transition, in a bath containing nickel ions with a layer of nickel of a thickness of up to 1 μm, which is effected, as a function of the concentration of the bath, within a dip-time of a few seconds. This nickel coating can be dispensed with in the case of unalloyed steels.

The subsequent electrolytic depositing of the base layer and the cover layer on the inner side is effected in special galvanization baths. It is desired to operate with a short period of immersion and a high-current yield and to deposit the desired layers within a few seconds. The socket is then stored in air at about 150° Celsius for about 1 to 2 hours so that absorbed hydrogen can diffuse out. For the melting of the tin portion of the base layer, the socket is preheated to about 200° to 210° Celsius and heated, from this preheating, for, for instance, about 10 seconds at about 250° Celsius or for about 5 seconds at about 280° Celsius, and then rapidly cooled to at least below the melting point of the tin. For the preheating, heating and quenching, the socket is immersed in liquid baths, for instance salt baths.

RESULTS

In screwing tests, sockets coated in such manner with metal coatings exhibit, upon more than 10 screwings and unscrewings, no galling phenomenon merely with the addition of oil and without the use of ordinarily utilized API greases.

While there has been described and illustrated a preferred embodiment of the present invention, it is apparent that numerous alterations, omissions and additions may be made without departing from the spirit and scope of the invention thereof.

What is claimed is:

1. A method of applyinga metallic coating to metallic sealing and/or threaded surfaces of steel pipes which surfaces may be subjected to a high pressure per unit surface during usage, said method comprising:

(a) pretreating the surface to be coated by cleaning and degreasing same;

(b) electrolytically depositing a base layer of tin or a tin-containing alloy to coat the surface;

(c) preheating the coated surface to a temperature between about 150° C. to about 200° C., followed by a second brief heat treatment lasting from about 1 to about 10 seconds at a temperature greater than the melting point of tin but not more than 50° K. above the melting point of tin to adhere the base layer to the surface undergoing coating by diffusion, wherein the heating temperatures are not greater than 50° K. above the melting point of tin; and (d) electrolytically depositing a ductile nonferrous metal or tin-containing alloy to form a cover layer over the base layer followed by a repetition of step c.

* * * * *